US007563355B2

(12) United States Patent
Graf et al.

(10) Patent No.: US 7,563,355 B2
(45) Date of Patent: Jul. 21, 2009

(54) CELL FOR GAS GENERATION

(75) Inventors: Walter Graf, Euerdorf (DE); Michael Weigand, Elfershausen (DE); Robert Glier, Röthlein (DE); Renate Glier, Röthlein (DE)

(73) Assignee: perma-tec GmbH & Co. KG, Euerdorf (DE)

( * ) Notice: Subject to any disclaimer, the term of this patent is extended or adjusted under 35 U.S.C. 154(b) by 0 days.

(21) Appl. No.: 12/074,842

(22) Filed: Mar. 6, 2008

(65) Prior Publication Data

US 2008/0226953 A1 Sep. 18, 2008

Related U.S. Application Data

(62) Division of application No. 11/076,530, filed on Mar. 9, 2005, now abandoned.

(30) Foreign Application Priority Data

Mar. 19, 2004 (DE) ..... 10 2004 013 593
Jul. 3, 2004 (DE) ..... 10 2004 032 260

(51) Int. Cl.
*C25B 1/00* (2006.01)

(52) U.S. Cl. ..... 205/617; 204/278

(58) Field of Classification Search ..... 204/278; 205/617
See application file for complete search history.

(56) References Cited

U.S. PATENT DOCUMENTS 4,167,807 A * 9/1979 Verity ..... 29/623.1
4,250,004 A * 2/1981 Miles et al. ..... 205/511
4,765,874 A * 8/1988 Modes et al. ..... 205/635
5,423,454 A * 6/1995 Lippman et al. ..... 222/1
5,567,287 A * 10/1996 Joshi et al. ..... 204/265
6,024,860 A * 2/2000 Cash et al. ..... 588/303
6,296,756 B1 * 10/2001 Hough et al. ..... 205/744
6,299,743 B1 * 10/2001 Oloman et al. ..... 204/252
6,689,262 B2 * 2/2004 Senkiw ..... 204/278.5
6,835,298 B2 * 12/2004 Oloman et al. ..... 205/617
7,306,711 B2 * 12/2007 Oloman et al. ..... 205/617
7,429,315 B2 * 9/2008 Oloman et al. ..... 204/278
2003/0019359 A1 * 1/2003 Shah et al. ..... 95/123
2004/0031695 A1 * 2/2004 Oloman et al. ..... 205/615

FOREIGN PATENT DOCUMENTS

DE 35 32 335 3/1987
DE 692 26 770 11/1992
WO WO92/19571 11/1992

* cited by examiner

*Primary Examiner*—Bruce F Bell
(74) *Attorney, Agent, or Firm*—Collard & Roe, P.C.

(57) ABSTRACT

A cell for gas generation is provided, particularly for the operation of a lubricant dispenser. The cell has two electrodes to be connected to a circuit containing a power source, and an aqueous electrolyte fluid located between the two electrodes, containing an azide having the formula $XN_3$, for electrochemical generation of a gas containing nitrogen ($N_2$). The electrolyte fluid contains a magnesium salt as an additive, for chemical binding of hydroxide ions that are formed during the electrochemical reaction.

15 Claims, 4 Drawing Sheets

CELL FOR GAS GENERATION

CROSS REFERENCE TO RELATED APPLICATIONS

Applicants claim priority under 35 U.S.C. §119 of German Application No. 10 2004 013 593.2 filed Mar. 19, 2004 and German Application No. 10 2004 032 260.0 filed Jul. 3, 2004. Applicants also claim priority under 35 U.S.C. 120 because this is a Divisional Patent Application of U.S. patent application Ser. No. 11/076,530 filed Mar. 9, 2005 now abandoned.

BACKGROUND OF THE INVENTION

1. Field of the Invention

The present invention relates to a cell for gas generation, particularly for the operation of a lubricant dispenser, having two electrodes to be connected to a circuit containing a power source, and an aqueous electrolyte fluid located between the two electrodes, containing an azide having the formula $XN_3$, for electrochemical generation of a gas containing nitrogen ($N_2$).

2. The Prior Art

In practice, it is known to meter the amount of lubricant that is dispensed by a lubricant dispenser by means of a gas-generating cell, whereby the pressure produced using the gas causes a corresponding exit of lubricant from the dispenser. In this connection, the generation of hydrogen or oxygen at the electrodes of a galvanic cell is known, for example from DE 35 32 335 C2. The cell can itself supply a sufficiently great voltage, if necessary with a zinc anode for generating hydrogen, or with a manganese dioxide cathode for generating oxygen. In this way, the electrolyte stream that flows between the electrodes can be regulated by way of an externally adjustable resistor. In addition, a battery can also be provided, which makes better regulation of the current intensity possible.

A gas cell is known from the reference DE 692 26 770 T2, wherein nitrogen is formed from a sodium azide solution, by means of electrolysis. In the electrolysis of an aqueous sodium azide solution, the gas generation rate quickly drops with the increasing formation of nitrogen. This gas generation rate drop arises because the hydroxide ions that are formed during the reaction result in a great increase in the pH of the solution, as the following reaction equation shows:

$$2NaN_3+2H_2O \rightarrow 3N_2+H_2+2\ NaOH$$

At high pH values, the formation of free nitrogen does not take place, and only water is decomposed. Usual buffer substances, e.g. phosphates, are unsuitable for solving this problem, since their buffering capacity is too low.

An improvement is possible, by means of adding potassium iodide and potassium thiocyanate, but these are substances that behave aggressively with regard to metals, so that accordingly, precious metals or graphite electrodes must be used.

SUMMARY OF THE INVENTION

It is an object of the present invention to provide a cell having the characteristics described initially, which has a good gas generation rate.

These and other objects are achieved in accordance with the invention, by a cell for gas generation in which the electrolyte fluid contains a magnesium salt as an additive, for chemical binding of hydroxide ions that are formed during the electrochemical reaction. It has now been found that magnesium hydroxide formed from the magnesium salt and the hydroxide ions has only a very small solubility product. Accordingly, the magnesium hydroxide is withdrawn from the reaction equilibrium in the electrolyte fluid. Furthermore, magnesium is electrochemically neutral in its compounds, and also the precipitated hydroxide gel, which contains water, does not noticeably influence the ion migration in the electrolyte fluid.

According to the invention, it is possible to keep the pH of the electrolyte fluid constant, within a narrow range, even with an increasing formation of nitrogen. Since the hydrazoic acid formed from the azide at first is a weak and, at the same time, a highly volatile acid, the solution is adjusted to be weakly alkaline right from the start. The electrolyte fluid can have a pH between 8 and 10. Preferably, the pH is 8-9.5. While it is practical if the azide is formed from sodium azide, magnesium sulfate or magnesium perchlorate is preferably used as the magnesium salt. In order to guarantee a sufficient withdrawal, from the electrolyte fluid, of the hydroxide ions that are formed, the magnesium salt is added stoichiometrically or in excess, in proportion to the amount of azide.

The electrolyte fluid can have an anti-freeze agent added to it, which preferably is made up of ethylene glycol and/or dimethyl sulfoxide. In this way, proper operation of the gas cell is guaranteed even at low temperatures. To prevent a hydrogen over-voltage of the electrode forming the cathode, the electrolyte fluid can contain nickel sulfate as an additive. In accordance with the invention, the direct oxidation of azide is possible not only on electrodes made of precious metals, but also on electrodes made of steel, preferably chrome-nickel steel, or graphite. Alternatively, the electrodes can be made of plastic with embedded graphite powder.

The present invention is directed to a method for gas generation comprising:

(a) providing a circuit comprising a power source;

(b) connecting first and second electrodes to said circuit; and (c) providing an aqueous electrolyte fluid between said electrodes comprising an azide having a formula $XN_3$ for generation of a gas containing nitrogen in an electrochemical reaction, said electrolyte fluid containing a magnesium salt for chemical binding of hydroxide ions formed during the electrochemical reaction.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings.

DETAILED DESCRIPTION OF PREFERRED EMBODIMENTS

Figure 1:
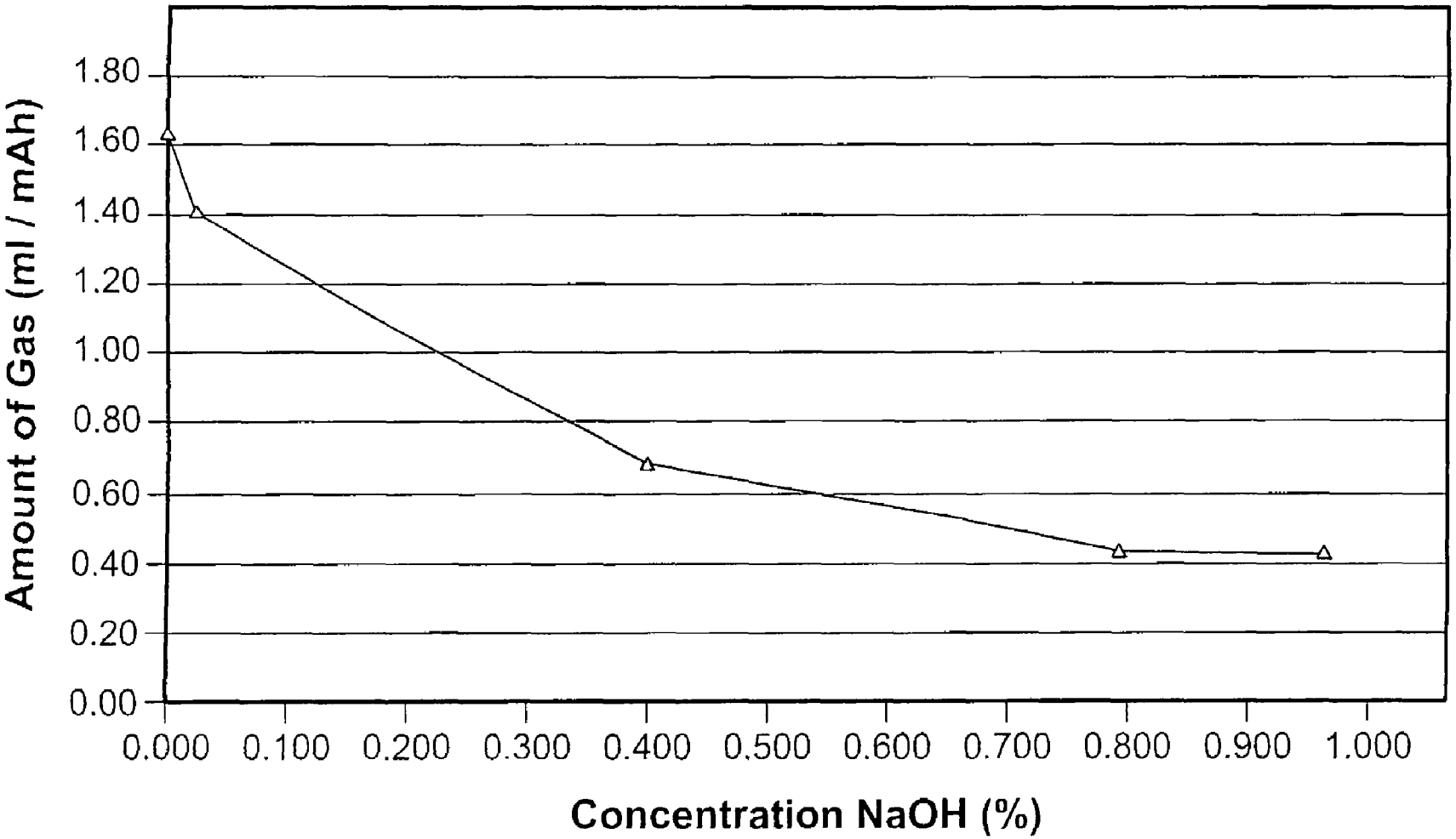
FIG. 1 shows the gas development from a pure sodium azide solution as a function of the content of free soda lye.

FIG. 1 shows a diagram that represents the gas development from a pure sodium azide solution according to the state of the art, as a function of the content of free soda lye. The soda lye that is formed during the decomposition of the azide, according to the equation

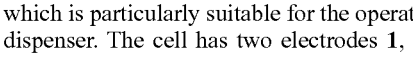

$$2NaN_3+2H_2O \rightarrow 3N_2+H_2+2\ NaOH$$

causes a clear reduction in the gas generation rate even in low concentrations. As a result, the effectiveness of the cell quickly drops with an increasing production of gas.

Figure 2:
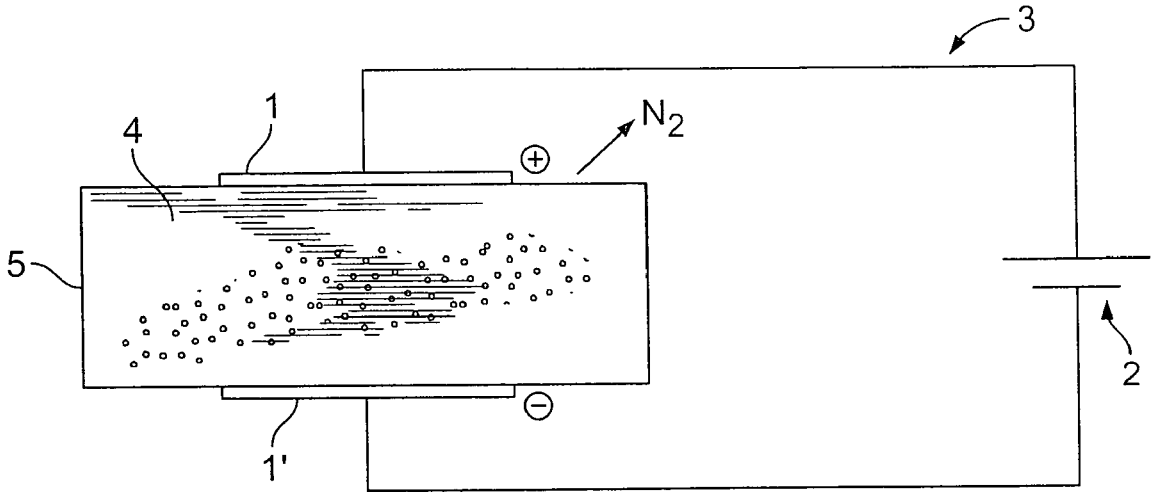
FIG. 2 shows the structure of a cell for gas generation, according to an embodiment of the invention.

FIG. 2 schematically shows the structure of a cell for gas generation, according to an embodiment of the invention, which is particularly suitable for the operation of a lubricant dispenser. The cell has two electrodes 1, 1' for being connected to a circuit 3 that contains a power source 2. Power source 2 can be made up of, for example, a commercially available battery button cell. An aqueous electrolyte fluid 4 containing sodium azide ($NaN_3$) is located between the two electrodes 1, 1', which fluid serves to generate a gas containing nitrogen ($N_2$). To accommodate electrolyte fluid 4, a suitable receptacle or accommodation body 5 is provided, e.g. in the form of a porous body or a container provided with bores. A sponge, a nonwoven fabric, or a similar storage medium can also be disposed in the container. By means of the voltage applied, the following reaction is brought about at the anode 1:

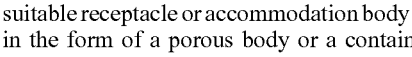

$$2N_3^- \rightarrow 3N_2+2e^-,$$

while a corresponding reduction of hydrogen ions takes place at the cathode 1':

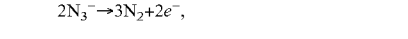

$$2H^+ + 2e^- \rightarrow H_2$$

Since hydrogen ions are used up during the reaction, in accordance with the reaction equation that applies for cathode 1', the concentration of the hydroxide ions clearly increases during the production of nitrogen. In order to avoid an accompanying increase of the pH in electrolyte fluid 4, a magnesium salt has been added to electrolyte fluid 4, for chemical binding of the hydroxide ions that are formed during the electrochemical reaction. Magnesium hydroxide has a very low solubility product. As a result, the magnesium hydroxide formed from the magnesium salt and the hydroxide ions is precipitated from electrolyte fluid 4 in accordance with the equation

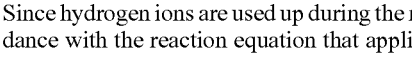

$$Mg^{2+}+2OH^- \rightarrow Mg(OH)_2,$$

which is formed at cathode 1'. The electrolyte fluid according to the invention makes it possible to use conventional materials, such as steel, preferably chrome-nickel steel, or graphite for electrodes 1,1'. Alternatively, electrodes 1, 1' can also be formed from plastic with embedded graphite powder.

EXAMPLE

The following electrolyte fluids were produced:

a) 15.0 g sodium azide,
31.0 g magnesium perchlorate, content 83 wt.-%, aqueous, 100 ml water.

b) Composition as in a), but with the addition of 0.25 g nickel sulfate $*6H_2O$.

The magnesium perchlorate binds the soda lye that is formed during the reaction, by forming magnesium hydroxide that has low solubility. This magnesium hydroxide is precipitated as a precipitate and is thereby withdrawn from the reaction equilibrium.

The use of magnesium perchlorate has the advantage that the electrolyte fluid remains liquid to below −20° C. As a result, anti-freeze agents need not be added, and the electrolyte fluid can easily be absorbed in a sponge. In this way, a simple separation of gas and electrolyte fluid, independent of the position, is present in practical operation. The disposal of a cell that contains the electrolyte fluid (see FIG. 2) can take place by means of incineration. The magnesium perchlorate is easily soluble in water, so that the electrolyte volume can be kept low. Even at temperatures of −20° C., the fluid demonstrates sufficient conductivity. Furthermore, perchloric acid is a stable compound that behaves as an inert substance under the stated conditions. The formation of elemental nitrogen takes place according to the following reaction equation:

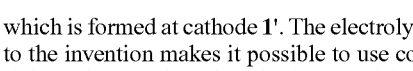

$$2NaN_3+Mg(ClO_4)_2+2H_2O \rightarrow 3N_2+H_2+Mg(OH)_2+2\ NaClO_4.$$

The solution is weakly alkaline, hygroscopic, odorless, not aggressive, and keeps without decomposing. 1 ml of this solution can yield 75 to 100 ml gas ($N_2$ and $H_2$), depending on the experimental conditions.

Figure 3:
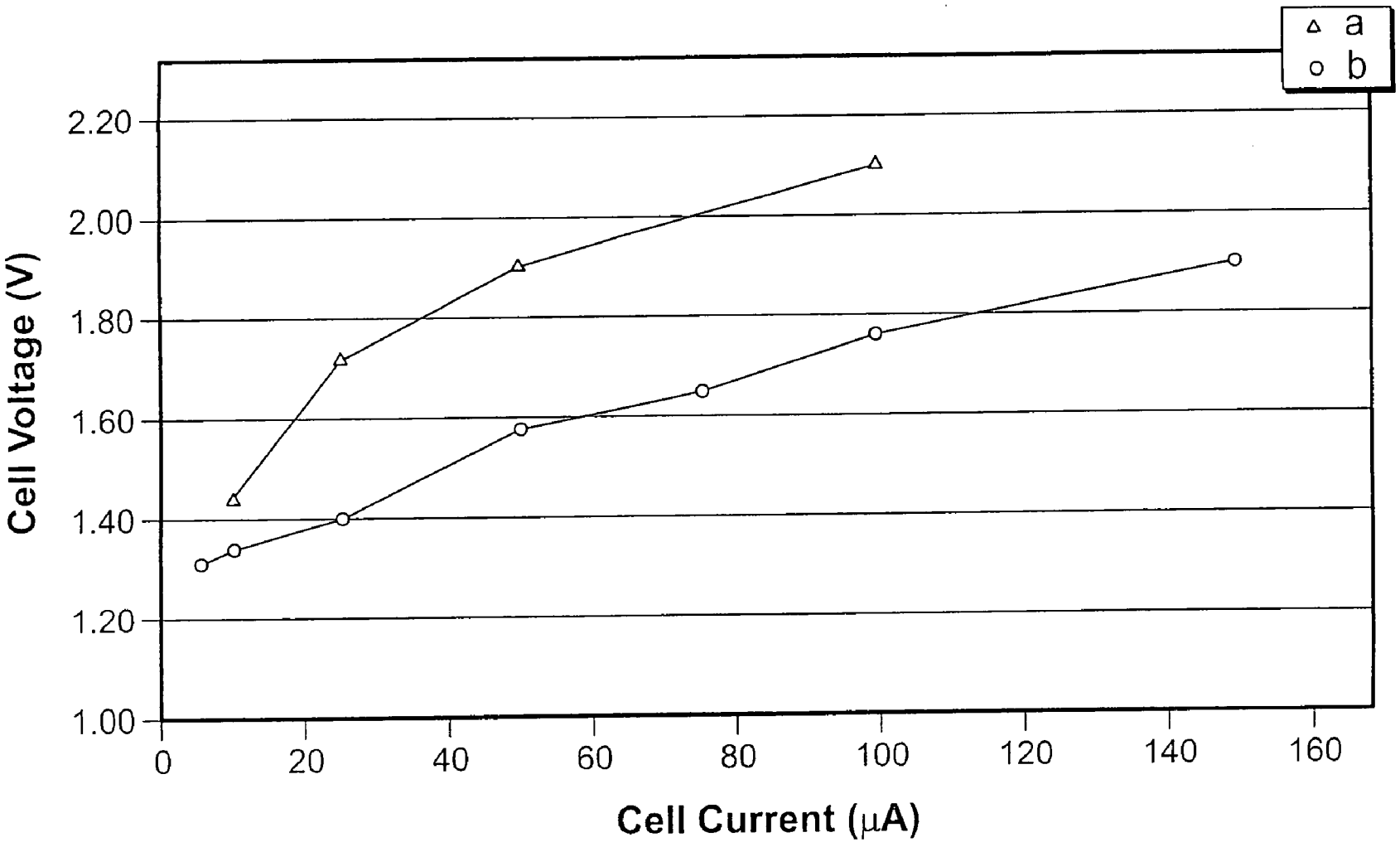
FIG. 3 shows the influence of nickel on the cell voltage.

FIG. 3 illustrates the effect of an addition of nickel sulfate according to Example b) on the total cell voltage, as a function of the electrolysis current intensity. In this connection, graphite electrodes 10 mm×10 mm were used. FIG. 3 shows that by adding nickel sulfate, the hydrogen over-voltage of the electrode forming the cathode can be reduced, and a correspondingly lower cell voltage is established at the same cell current, in comparison with solution a).

Figure 4:
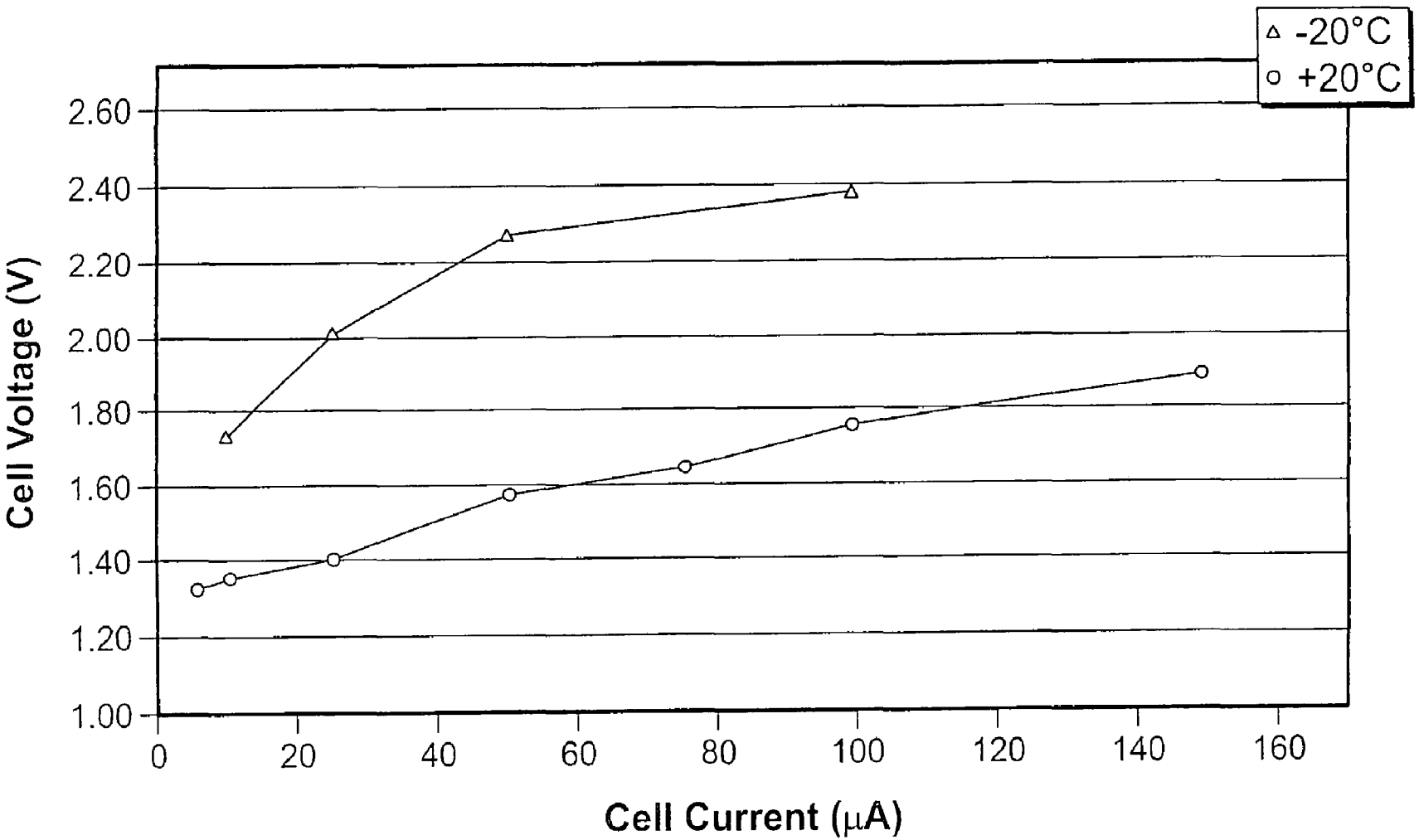
FIG. 4 shows the cell voltage as a function of the cell current, at different temperatures.

FIG. 4 illustrates the progression of the cell voltage as a function of the current intensity, at +20° C. and −20° C. It is evident that lowering the temperature requires a higher cell voltage at the same cell current. The diagram shown in FIG. 4 was drawn up for the electrolyte fluid according to Example b), which still guarantees sufficiently great cell currents even at −20° C., thereby making use of the cell according to the invention possible.

While a few embodiments of the present invention have been shown and described, it is to be understood that many changes and modifications may be made thereunto without departing from the spirit and scope of the invention as defined in the appended claims.

What is claimed is:

1. A method for gas generation comprising:

(a) providing a circuit comprising a power source;

(b) connecting first and second electrodes to said circuit; and (c) providing an aqueous electrolyte fluid between said electrodes comprising an azide having a formula $XN_3$ for generation of a gas containing nitrogen in an electrochemical reaction, said electrolyte fluid containing a magnesium salt for chemical binding of hydroxide ions formed during the electrochemical reaction.

2. The method according to claim 1, wherein the azide comprises sodium azide.

3. The method according to claim 2, wherein the magnesium salt comprises magnesium sulfate.

4. The method according to claim 2, wherein the magnesium salt comprises magnesium perchlorate.

5. The method according to claim 1, wherein the magnesium salt comprises magnesium sulfate.

6. The method according to claim 1, wherein the magnesium salt comprises magnesium perchlorate.

7. The method according to claim 1, wherein the magnesium salt is added stoichiometrically or in excess with regard to the amount of azide.

8. The method according to claim 1, further comprising an anti-freeze agent added to the electrolyte fluid.

9. The method according to claim 8, wherein the antifreeze agent comprises a member selected from the group consisting of ethylene glycol, dimethyl sulfoxide, and mixtures thereof.

10. The method according to claim 1, wherein the electrolyte fluid contains nickel sulfate to prevent a hydrogen overvoltage of one of said first and second electrodes that forms a cathode.

11. The method according to claim 1, wherein the electrodes comprise steel.

12. The method according to claim 11, wherein the electrodes comprise chrome-nickel steel.

13. The method according to claim 1, wherein the electrodes comprise graphite.

14. The method according to claim 1, wherein the electrodes comprise plastic with embedded graphite powder.

15. A method for operating a lubricant dispenser, said method comprising:

(a) providing a circuit comprising a power source;

(b) connecting first and second electrodes to said circuit;

(c) generating gas by providing an aqueous electrolyte fluid between said electrodes comprising an azide having a formula $XN_3$ for generation of a gas containing nitrogen in an electrochemical reaction, said electrolyte fluid containing a magnesium salt for chemical binding of hydroxide ions formed during the electrochemical reaction; and (d) metering the amount of lubricant that is dispensed by the lubricant dispenser by means of the generated gas, whereby the pressure produced due to the generated gas causes a corresponding exit of lubricant from the dispenser.

* * * * *